US005884438A

United States Patent [19]

Westhoff et al.

[11] Patent Number: 5,884,438

[45] **Date of Patent: *Mar. 23, 1999**

[54] LIFT INSERT ASSEMBLY AND FABRICATION ASSEMBLY METHOD THEREFORE

[75] Inventors: James A. Westhoff, Langhorne; James A. Kelly, Reiglesville, both of Pa.

[73] Assignee: Poly-Tec Products, Inc., Tullytown, Pa.

[ * ] Notice: The term of this patent shall not extend beyond the expiration date of Pat. No. 5,860,254.

[21] Appl. No.: 805,211

[22] Filed: Feb. 27, 1997

Related U.S. Application Data

[60] Provisional application No. 60/012,390, Feb. 28, 1996.

[51] Int. Cl.[6] ..... B25B 29/00

[52] U.S. Cl. ..... 52/125.5; 52/125.5; 294/89

[58] Field of Search ..... 52/122.1, 124.1, 52/124.2, 125.1, 125.2, 125.3, 125.4, 125.5, 704, 707, 709, 698, 699; 294/89, 1.1, 82.1, 82.29, 82.31

[56] References Cited

U.S. PATENT DOCUMENTS

| | | | |
|---|---|---|---|
| 3,705,469 | 12/1972 | Eriksson | 52/125.3 |
| 4,018,470 | 4/1977 | Tye | 294/89 |
| 4,087,947 | 5/1978 | Turner | 52/125.4 |
| 4,088,361 | 5/1978 | Ditcher | 294/89 |
| 4,325,575 | 4/1982 | Holt et al. | 294/89 |
| 5,568,711 | 10/1996 | Popp et al. | 52/704 |

FOREIGN PATENT DOCUMENTS 1277847 10/1987 Canada .

*Primary Examiner*—Carl D. Friedman
*Assistant Examiner*—Beth A. Aubrey
*Attorney, Agent, or Firm*—Louis Weinstein

[57] ABSTRACT

A lift pin insert assembly is releasably mounted upon a mold member for casting a manhole section. The mold is filled with concrete, which surrounds and embeds the insert assembly in the cast member. The insert is configured to receive a lift pin, which is automatically moved to a locked position when a lifting force is applied. The insert assembly includes a reinforcing support assembly having at least a face plate and a metal rod of suitable thickness engaging the insert, and anchored either to the face plate or an additional support plate. The support assembly distributes the forces applied by the lifting force to the cast member substantially uniformly over a large surface area, significantly increasing the weight load capable of being lifted by a given lift pin without increasing the size and/or diameter of the lift pin and blocks the lift pin from sliding out of the insert when the cast member is lifted by the lift pin.

40 Claims, 6 Drawing Sheets

LIFT INSERT ASSEMBLY AND FABRICATION ASSEMBLY METHOD THEREFORE

This application claims benefit of Provisional Application Ser. No. 60/012,390 filed Feb. 28, 1996.

FIELD OF THE INVENTION

The present invention relates to inserts provided in cast members for use with lift pins and the like, and more particularly to a novel insert assembly, incorporating a supporting structure which greatly increases the load lifting capability of a lift pin without altering its physical size and/or strength characteristics, as well as providing a fabrication and assembly method therefore.

BACKGROUND OF THE INVENTION

In the construction industry, it is not only well-known, but it is preferred that concrete structures and/or components be precast at the factory, and delivered to a job site for installation. Precasting has many advantages over in situ casting, the primary factors of which include the casting of components having greater precision and tighter tolerances, the consistency of product's specifications and reduced costs, which go hand-in-hand with use of mass assembly techniques as compared with one-at-a-time in situ casting.

Nevertheless, precast concrete structures of sizable dimensions are quite heavy, in many cases weighing thousands of pounds. For example, conventional precast manhole sections typically range in weight from 800 to 16,400 pounds each, necessitating the use of mechanical lifting and moving equipment.

Apparatus employed in one preferred technique for handling precast manhole sections is described in U.S. Pat. No. 4,088,361, which is incorporated herein by reference thereto. As is described therein, precast manhole sections are each provided with a pair of plastic inserts, which are releasably mounted upon an outer wall of a mold assembly in which a manhole section is cast so as to be embedded into the cast member.

The plastic insert has a cavity of a predetermined shape configured to receive a lift pin. At least two such insert assemblies are provided in each cast member, being arranged diametrically opposite one another. Additional inserts may be used, when needed, to handle cast members of greater weight, the inserts being arranged at spaced intervals about the cast member.

A lift pin in inserted into each insert. A lifting apparatus for lifting and moving the precast section, applies lifting tension to the lift pins, which cause the pins to rotate 90° from an initial horizontal ("9 o'clock") position to a vertical (12 o'clock") position where they become locked within the inserts and hence the cast member to assure that the pins are not dislodged during lifting and movement of the precast member to assure that these operations are performed in a safe manner.

When the precast member is delivered to the desired location, for example, upon the flat bed of a truck for delivery from factory to installation site, the lifting mechanism moves the precast member to an installation site and is lowered, which relaxes the lifting tension at which time the lift pins are rotated from the vertical to the horizontal position for easy removal.

Although concrete has a maximum compressive strength of 4,000 PSI, as the diameter and wall thickness of manhole sections increases, the cantilever forces developed by the lift pin and exerted upon the lift pin insert and hence the cast member increase in magnitude due to the increased weight of the cast member which causes the cast material to fracture.

One technique which has been employed by the Applicant for increasing the structural supporting strength of the insert is to wrap a rebar about the periphery of the plastic insert so that the rebar forms a substantially V-shaped configuration with a loop being provided about the plastic insert at the apex of the V-shaped rebar. This arrangement has provided only a small improvement in the amount of load which a cast member can withstand before fracturing.

In addition, it is extremely advantageous to provide lift pin and insert assemblies which are usable in cast members having a wide range of weights and sizes, thereby reducing if not substantially eliminating, the need to provide a large inventory of lift pins of different sizes to accommodate the lifting and handling of cast members of different sizes and weights.

BRIEF DESCRIPTION OF THE INVENTION

The present invention provides an insert assembly and method of fabrication and assembly therefor, which incorporates all of the advantageous features and objectives set forth hereinabove, and is characterized by comprising a plastic insert of conventional design utilized together with an assembly which supports the plastic insert and includes a faceplate arranged to be substantially flush with an outer periphery of the cast member. At least one rebar is secured to the faceplate, preferably by welding, and encircles and preferably either engages or lies in close proximity to the insert.

The orientation of the plastic insert, and the manner in which the lift pin inter-engages and locks with the insert is substantially the same as in a conventional design described in U.S. Pat. No. 4,088,361 so that, when a cast member is lifted, the lift pins, in addition to rotating (from "9 o'clock" to "12 o'clock"), tend to pivot in a direction so that their free ends are urged downwardly by the weight of the cast member. This tendency to pivot can cause the lift pin to slip out of the insert and crush and/or fracture the cast material in the path of the lift pin. The forces exerted upon the cast member due to the lifting thereof are distributed over the face of the faceplate engaging the cast member as well as the rebar assembly, which prevents deplaning, i.e. separation of the cast material from the faceplate. The insert support assembly also prevents fracturing of the cast material, thus enhancing its structural integrity, assuring a long, useful operating life.

The hollow, plastic insert has an internal shape, which is specifically adapted to receive the free end of the lift pin, and to positively seat a right-angle projection provided near the free end of the lift pin, which serves as a locking pin, wherein the lift pin is automatically moved to a locking position when lifting tension is applied thereto. By placing a portion of the rebar adjacent to a wall of the portion receiving the locking pin provided on the lift pin, the locking pin is prevented from sliding out of the insert and/or damaging the insert and the cast material. The lift pin is ultimately removed by rotating in the opposite direction after the lifting tension is eased.

In one preferred embodiment, the support assembly for the plastic insert receiving the lift pin is preferably fabricated independently of the plastic insert after which the plastic insert is placed in the support assembly to protect the plastic insert from damage or distortion due to the heat generated during welding operations employed to join the rebar and faceplate.

In another preferred embodiment, the insert support assembly is provided with an additional support plate welded to and extending from the faceplate. A rebar is welded to the faceplate and/or the support plate, and is bent or otherwise shaped, either independently or in combination with the support plate to substantially encircle the plastic insert. The rebar may also be secured to the support assembly by wire ties. The size of the space encircled by the rebar or the rebar and support plate is sufficient to assure proper placement of the plastic insert within the support assembly after welding of the support elements. The support plate may be positioned so that a plane passing through a major face thereof is either horizontally or vertically aligned when the assembly is placed into and ultimately embedded in a cast member after it has set. The vertical orientation of the support plate assures more uniform distribution of the cast material, and prevents the formation of bubbles, and/or air pockets in the region of the insert support assembly. The horizontal support plate serves the dual functions of spreading the pivoting force of the lift pin over a large surface area to prevent the concrete from being damaged during lifting by the lift pins and also secures the U-shaped rebar.

A portion of the rebar is placed in close proximity and preferably engaging an inward vertically aligned surface of the insert to prevent crushing of the cast material surrounding the upper, inward end of the insert by the lift pin due to the tendency of the lift pin to pivot downwardly and to slip out of the insert as it is moved to a vertical, locking position.

The support assembly, with the plastic insert properly positioned therein, is mounted upon a mold member, and is releasably secured thereto by means of a releasable locking member, which holds the insert and its support assembly in the proper position during casting, and which is removed when the cast member is set.

In other preferred embodiments, a U-shaped rebar is snap-fitted into place between a pair of hook-shaped projections provided on a support plate and then either welded in place or secured to the support plate by wire ties. The use of wire ties avoids the danger of damaging the plastic insert from the heat of welding, enabling the insert to be placed into position before the wire ties are wrapped around the rebar.

The insert support assembly provides enhanced structural strength and integrity for cast members over a wide weight range to be safely lifted and handled by lifting equipment using a lift pin of a given size, strength and dimension, which is capable of safely lifting cast members over a size and weight range whose upper end is over 8,000 pounds, thus greatly simplifying the number of lifting components required for safely handling and lifting the aforesaid wide range of cast members.

OBJECTS OF THE INVENTION

It is therefore one object of the present invention to provide a novel support assembly for lift pin receiving inserts employed in cast members and the like.

Still another object of the present invention is to provide novel support assemblies for plastic inserts employed in cast members to permit such cast members to be safely lifted and handled by lift pins whereby the insert support assemblies permit lifting of cast members over a weight range not heretofore possible through the use of conventional inserts.

Still another object of the present invention is to provide novel support assemblies for plastic inserts for lift pins, which provide greater, more even distribution of compressive forces within the cast member to permit lifting and handling of cast members at weights not heretofore possible through the employment of conventional apparatus.

Still another object of the present invention is to provide novel support assemblies for plastic inserts for lift pins utilizing a metallic support structure comprised of a faceplate, and a member joined to said faceplate for supporting the plastic insert, and hence a lift pin inserted therein during lifting to assure safe lifting of the cast member without damaging or fracturing the cast material.

Still another object of the present invention is to provide novel support assemblies for plastic inserts for lift pins utilizing a metallic support structure comprised of a faceplate, and a member joined to said faceplate for supporting the plastic insert and to prevent a locking pin provided on a lift pin inserted into each of the inserts from sliding out of the insert when the cast member is lifted.

Still another object of the present invention is to provide a novel method for fabrication of plastic insert support assemblies to protect the inserts from damage.

Still another object of the present invention is to provide a novel method for fabrication of plastic insert support assemblies to protect the inserts from damage in which elements of the support assembly are secured to one another by wire ties.

BRIEF DESCRIPTION OF THE FIGURES

The above, as well as other objects of the present invention, become apparent upon consideration of the following description and drawings in which.

DETAILED DESCRIPTION OF THE INVENTION AND PREFERRED EMBODIMENTS THEREOF

Figure 1B:
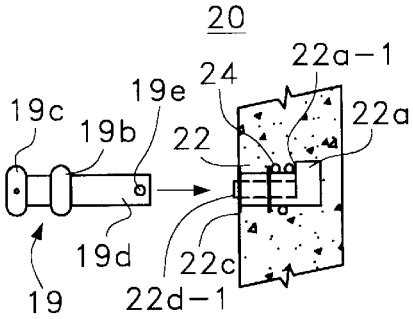
FIGS. 1*b*–1*e* are figures useful in explaining the manner in which a lift pin is locked into position within an insert assembly, FIGS. 1*b* and 1*d* showing side views, partially sectionalized of a lift pin and an insert assembly, and FIGS. 1*c* and 1*e* respectively showing front views of FIG. 1*b* and 1*d*.
Figure 1C:
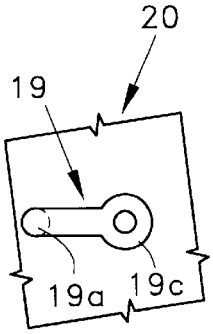
Figure 1:
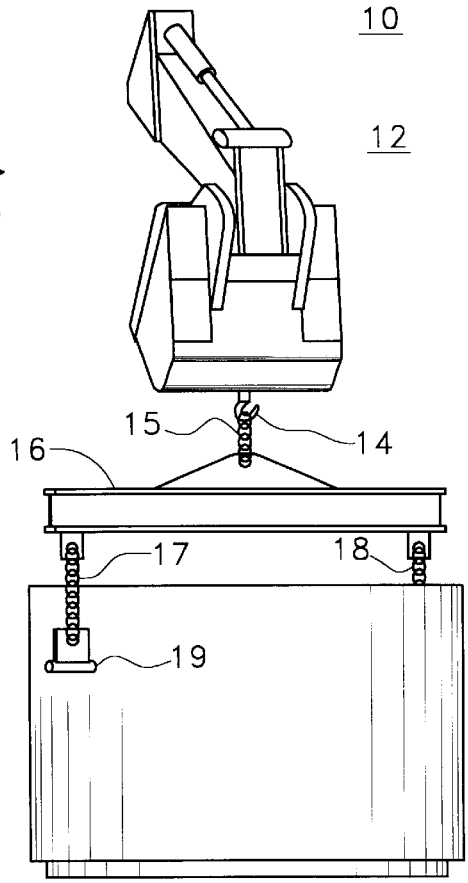
FIG. 1 shows a perspective view of a cast member, incorporating the apparatus of the present invention, and the manner in which the cast member is lifted and handled.

FIG. 1 shows apparatus 10 for lifting and handling cast member 20, said apparatus comprising a conventional mechanism 12, such as a crane, for lifting and moving the cast member 20. Obviously any other lifting and moving apparatus may be utilized such as overhead cranes and the like. The lifting and moving apparatus 12 may comprise a hook 14. A short section of chain 15 is suspended on hook 14, and has its lower end supporting a spreader bar 16. A pair of chains 17 and 18 are supported at opposite ends of bar 16. The lower ends of the chains are each secured to a lift pin 19, only one of which is shown in FIG. 1.

Figure 1D:
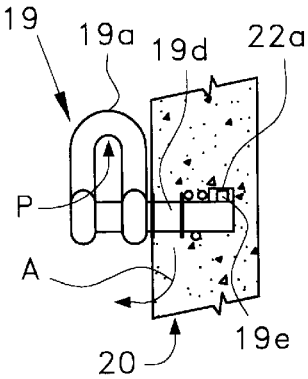
Figure 1E:
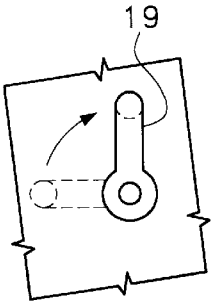
Figure 1A:
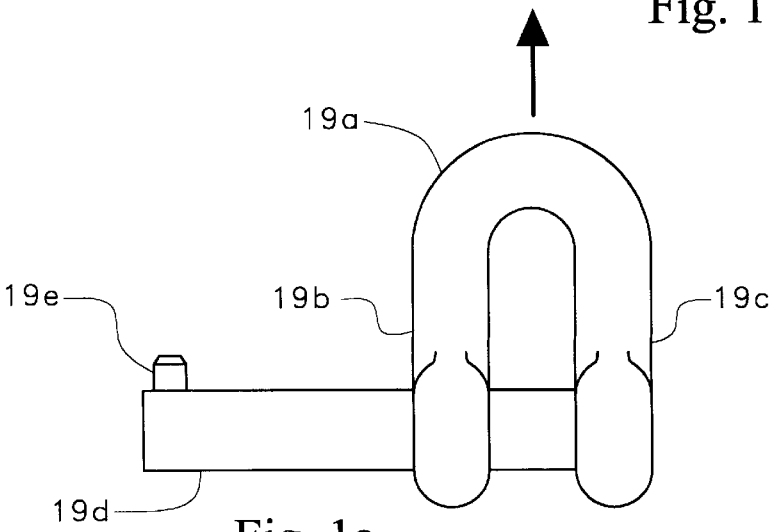
FIG. 1*a* is a plan view of a lift pin usable with the insert assembly of the present invention.

FIG. 1*a* shows a typical lift pin 19 in greater detail. The lift pin is comprised of a substantially U-shaped portion 19*a*. The free ends of the arms 19*b* and 19*c* of U-shaped portion 19*a* are each provided with openings for receiving a cylindrical-shaped rod 19*d* welded or otherwise secured to U-shaped portion 19*a*. The free end of rod 19*d* is provided with a pin 19*e,* which extends at a right-angle from rod 19*d*.

The lift pins 19 are each inserted into an associated plastic insert (not shown in FIG. 1). The manner of insertion and locking will be described hereinbelow. The inserts are embedded in the precast member and their open ends for receiving a lift pin are arranged about the outer periphery of cast member 20, and are diametrically opposed to one another.

FIGS. 1*b* and 1*c* respectively show a sectional view and a front view of a plastic lift insert 22 embedded within cast member 20. A reinforcement loop 24 formed of a No. 3 rebar encircles the insert to provide added reinforcement for the insert during lifting. A No. 3 rebar is a rod typically formed of R 40 steel and having a diameter of ⅜ inches.

Lift pin 19 is aligned for insertion so that its U-shaped portion lies in a substantially horizontal plane. Lift pin is moved into insert 22 until the free end thereof provided with pin 19*e* abuts against the inward (i.e. right-hand) end of insert 22. The lift pin 19 is oriented in the "9 o'clock" position shown in FIG. 1*c*.

When a lifting force is applied to each lift pin 19, the lift pins rotate from the "9 o'clock" position shown in FIGS. 1*b* and 1*c* to the "12 o'clock" position shown in FIGS. 1*d* and 1*e* whereby the U-shaped portion 19*a* of lift pin 19 is rotated clockwise to the vertical position. The projection 19*e* is locked into the projection receiving portion 22*a* of insert 22, retaining the lift pin in the locked position during lifting and handling of cast member 20. The lift pin cannot be pulled out of the insert when in the "12 o'clock" position due to the pin 19*e* abutting shoulder 22*a*-1. The details of the lift pin insert 22 are shown in U.S. Pat. No. 4,088,361 and are omitted herein for purposes of brevity.

Insert 22, in addition to providing locking of the lift pin 19 during lifting and handling of the cast member 20, provides a watertight and economically effective means for handling precast members such as manholes and other concrete structures. The insert is preferably compounded from polypropylene, and is fabricated in such a manner that a predetermined thickness of concrete forms a barrier to prevent infiltration of water into the structure. The insert is installed during the casting process, and forms an integral of the cast member. If desired, the insert may be formed of any other plastic material exhibiting the desirable characteristics of polypropylene.

The shape of the cavity 22*a* receiving the projection at the end of the lift pin assures minimum movement of the lifting device during handling, as well as locking the lifting device during lifting and handling.

Figure 5A:
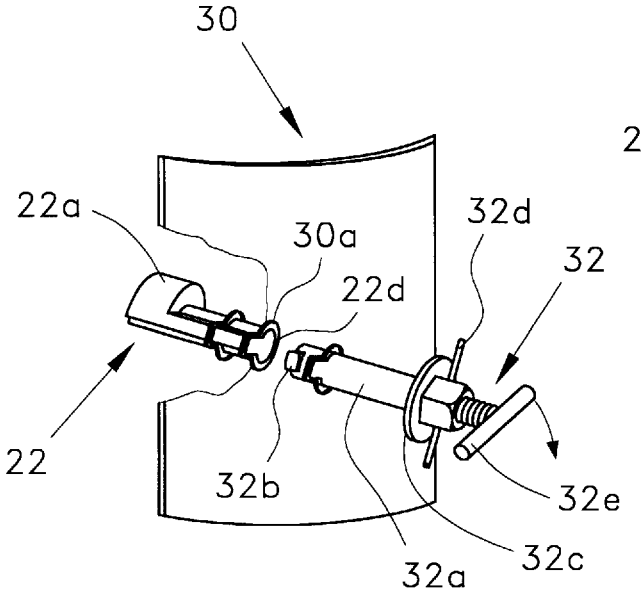
FIG. 5*a* and 5*b* are perspective views showing the manner in which an insert is mounted to a mold member for embedment in a cast member.
Figure 5B:
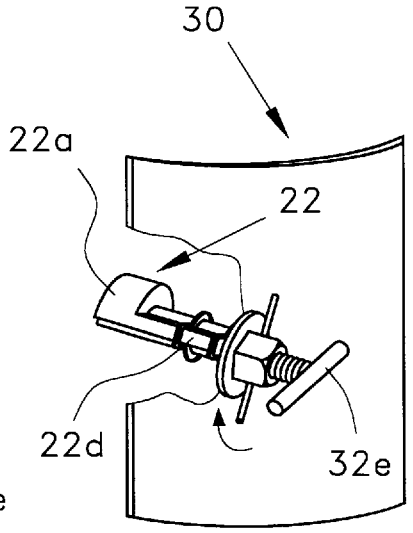

FIGS. 5*a* and 5*b* show the manner in which the insert is integrated into the cast member.

FIG. 5*a* shows a portion of an exterior mold member 30 having a keyhole-shaped opening 30*a* for receiving inserts 22. Insert 22 is positioned along the interior concave surface of the mold member 30, and is aligned with opening 30*a*. A flange 22*c* rests against the concave surface. The end portion 22*d*-1 of the spline 22*d* of insert 22, which projects beyond flange 22*c,* extends into the square-shaped portion of the keyhole-shaped opening 30*a* (see FIG. 2*b*). A steel pin 32*a* forming part of a locking assembly is aligned with opening 30*a* and insert 22, and is moved into the insert so that its projection 32*b* is aligned with the spline portion 22*d* of the keyhole-shaped opening of the insert.

Pin 32*a* is moved to the position where flange 32*c* engages the exterior surface of mold member 30. Pin 32*a* is then rotated 180° by manipulation of the operating handle 32*d,* moving projection 32*d* into a locking position within projection receiving cavity 22*a* of insert 22. Wing nut 32*e* is then tightened to secure the insert into position whereupon the cementitious material, i.e. concrete, is poured into the assembly mold. Techniques such as vibration are preferably utilized to cause the cementitious material to be compacted and evenly distributed throughout the mold interior, and to prevent the formation of air pockets and/or bubbles.

When the cast material has set, wing nut 32*e* is loosened, pin 32*a* is rotated counterclockwise through 180°, and is removed from the cast member.

When the cast member is removed from the mold, and has been adequately cured, the inserts may be utilized in the manner described hereinabove for lifting and handling operations.

When a cast member is lifted in this manner, each lift pin tends to pivot. For example, lift pin 19, shown in FIGS. 1*d* and 1*e,* tends to pivot in a clockwise direction about a pivot point P, the direction which the pin tends to pivot being shown by arrow A. This pivoting can lead to a tendency of the pin 19*d* to slide out of the insert causing locking pin 19*e* to break through the insert and fracture and/or crush the cast material lying between wall 22*a*-1 and the outer surface of the precast member. A rebar member prevents this from occurring, as will be described in more detail hereinabove.

The weight of the cast member is counteracted by the compressive force of the cast material, such as concrete.

Concrete has a compressive strength of 4,000 PSI. For a lift pin of a given size, the weight of a cast member which can be lifted thereby is limited, necessitating a larger lift pin as the cast member increases in wall thickness and weight, requiring that fabricators inventory a wide range of lift pins, and cooperating inserts in order to be able to handle cast members over a wide range of sizes, thereby increasing both the costs and complexity involved in the fabrication and handling of cast members having lift pin inserts.

The present invention significantly increases the weight range of cast members which a lift pin of a given size and strength is capable of lifting through the employment of a novel support assembly as will be described hereinbelow.

Figure 2:
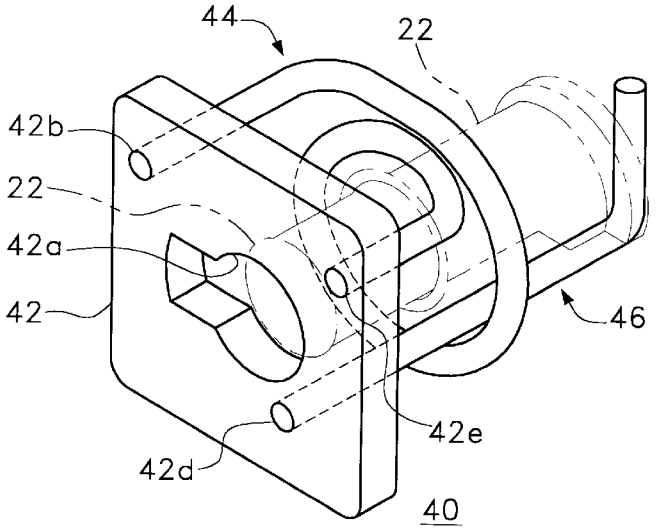
FIG. 2 is a perspective view showing one preferred embodiment of the insert support assembly of the present invention.
Figure 2A:
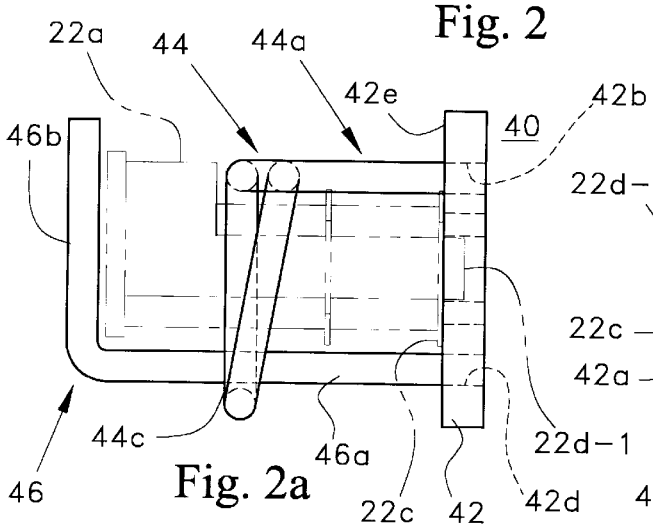
FIG. 2*a* shows a side view thereof, partially sectionalized.
Figure 2B:
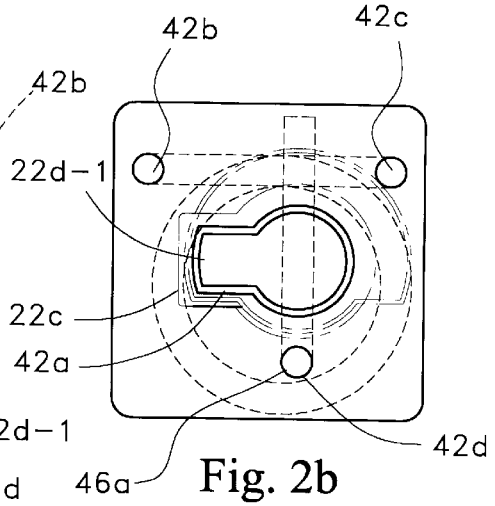
FIG. 2*b* is a front view of FIG. 2*a*.

FIGS. 2, 2*a* and 2*b* show one preferred embodiment of a support assembly 40 comprised of a faceplate 42 of a substantially rectangular-shape having a keyhole-shaped opening 42*a,* the square-shaped portion thereof receiving and positioning spline portion 22*d*-1 of the forward, open end of insert 22*b* of insert 22.

Openings 42*b,* 42*c* and 42*d* are provided for receiving the free ends of rebar members 44 and 46.

Rebar member 44 has an intermediate portion thereof bent or otherwise formed into a loop 44*c* of at least one full turn adapted to encircle insert 22 in the manner shown. The free ends of the looped rebar 44 are formed into a pair of substantially parallel anchoring portions 44*a* and 44*b,* are respectively inserted into the openings 42*b* and 42*c,* and are secured thereto, preferably by welding.

The substantially L-shaped rebar 46 has a first arm 46*a* extending along the underside of insert 22. The free end thereof is inserted into opening 42*d* and, in one embodiment is secured thereto preferably by welding. The remaining arm 46*b* extends along and lies adjacent to the left-hand end of insert 22. Arm 46*a* lies within the one turn loop 44*c* and along the underside of insert 22.

The insert support assembly 40 and plastic insert 22 are held in position within the mold assembly substantially in the same manner as was described hereinabove with regard to the insert per se. The faceplate 42 is positioned along the concave inner periphery of an outer mold member. The mold member is provided with a keyhole-shaped opening conforming to the openings in the insert 22 and faceplate 42.

In the embodiment shown, the rebars 44 and 46 encircle the insert in such a manner as to require that the insert be placed within the rebars before the welding operation. The welding operation creates a significant amount of heat which is conducted to the insert by the metallic members 42, 44 and 46 which results in damage and/or distortion of the insert, often rendering it unusable.

One technique for protecting the plastic insert is to weld the ends of rebar 44 to faceplate 42, and to fabricate opening 42*d* to provide a tapped opening and provide arm 46*a* with a threaded end for threadedly engaging tapped opening 42*d,* enabling the insert to be placed inside loop 44*c* and its free end against opening 42*a,* after rebar 44 is welded to faceplate 42, and thereafter inserting and threadedly engaging rebar 46 with the tapped opening 42*d* and faceplate 42.

Another technique which may be utilized to protect the plastic insert is to increase the interior diameter of the loop 44*c* to permit insert 22 to be inserted at an angle to a central axis aligned with the center of the loop provided for encircling the insert and then properly aligned with opening 42*a* after the left-hand end of the insert is clear of arm 46*b* of rebar 46.

Still another technique for protecting the insert 22 is to form the material capable of withstanding the heat generated during welding such as metal or a suitable plastic.

When cast member 20, having the inserts 22 and lift assembly 40 embedded therein, is lifted by a pair of lift pins 19, the internal forces exerted by the concrete are distributed over the entire area of the left-hand surface 42*e* of faceplate 42 as well as the entire surface area of the rebars 44 and 46.

The weight of the cast member 20 acts to urge the rod 19*d* and pin 19*e* downwardly (as was described hereinabove—see FIG. 1*d*) causing this force to be applied to insert 22 and hence rebars 44 and 46. Rebars 44 and 46 are supported by faceplate 42 being rigidly secured thereto. As pin 19*e* moves toward the "12 o'clock" position during lifting, the weight of the precast member is applied to the lifting pin which pivots, developing the tendency to slide out of the insert. By placing the portion 44*c*-1 of rebar 44 against wall 22*a*-1 this blocks the pin 19*e* from moving and thereby crushing or damaging the insert and the cast material as pin 19*e* tends to move out of the insert (see FIGS. 1*d* and 1*e*). The positioning of rebar portion 44*c*-1 against wall 22*a*-1 thus positively locks the locking pin 19*e* from moving out of the portion 22*a* of insert 22 during lifting. In addition, the significantly increased surface area of the interface between the members of insert support assembly 40 and the concrete significantly reduces the concentration of forces acting upon the concrete enabling the employment of a given size lift pin for lifting cast members over a significantly broader range of sizes and weights.

For example, two lift pins capable of safely lifting cast members of a maximum weight of 9,000 pounds when using conventional inserts and reinforcement techniques, is capable of safely lifting cast members of up to 16,400 pounds when employing the insert support assembly of the present invention, thus eliminating the need for a wide range of lift pins otherwise required to lift and handle the cast members over a broad range of sizes and weights. Rebars of a greater diameter such as a No. 4 rebar (having a diameter of 7/16 inches) can be substituted together with a larger size insert for handling cast members of sizes and weights beyond the range set forth above.

Figure 3A:
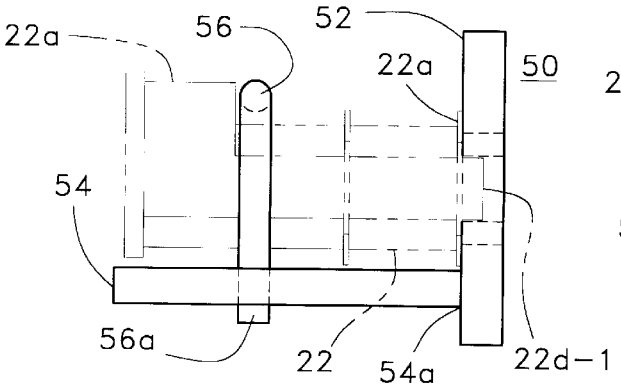
FIG. 3*a* is a side view showing a second preferred embodiment of the insert support assembly of the present invention.
Figure 3B:
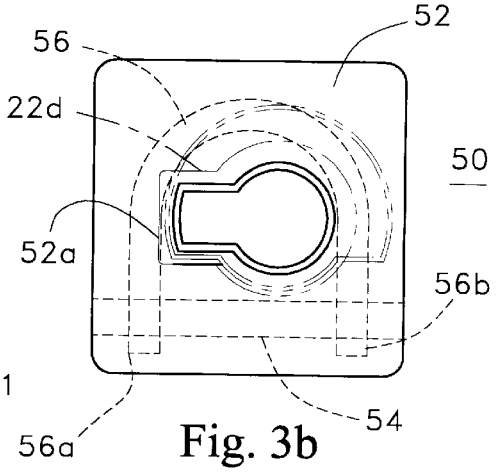
FIG. 3*b* shows a front view thereof.

FIGS. 3*a* and 3*b* show still another embodiment 50 of the present invention comprised of a faceplate 52 similar to faceplate 42, and having an opening 52*a* similar to opening 44*c*.

A support plate 54, formed of a solid piece of flat stock, has its right-hand end 54*a* engaging and welded to a lower end of faceplate 52. Support plate 54 is provided with openings 54*b* and 54*c* respectively receiving free ends of a substantially U-shaped rebar 56, the rebar 56 being welded to plate 54 after insertion. Rebar 56 cooperates with plate 54 to encircle insert 22 and rests against the right-hand, exterior surface of the pin receiving and locking portion 22*a* of insert 22, as shown. The upper major face 54*d* of plate 54 is positioned beneath the underside of insert 22. Portion 56*c* of rebar 56 is positioned to block pin 19*e* from sliding out of the insert and also prevent the concrete adjacent to the insert portion 22*a* from being crushed, in the same manner as the rebar portion 44*c*-1 shown in FIGS. 2*a* and 2*b*. The increased surface area between the surfaces of members 52, 54 and 56, and the concrete serve to distribute the counteracting forces over a larger surface area, providing significantly increased supporting strength and, similar to the embodiment 40, enables the use of a lifting pin for lifting cast members having sizes and weights over a significantly wider range, similar to that of the embodiment 40. The plate 54 prevents the tendency of the lift pin to pivot from crushing the concrete beneath plate 54, as well as counteracting the effect of the pivoting lift pin. The U-shaped rebar is secured to the plate 54 increasing its structural integrity and ability to lock the locking pin 19*e* against movement during the lifting.

Figure 6A:
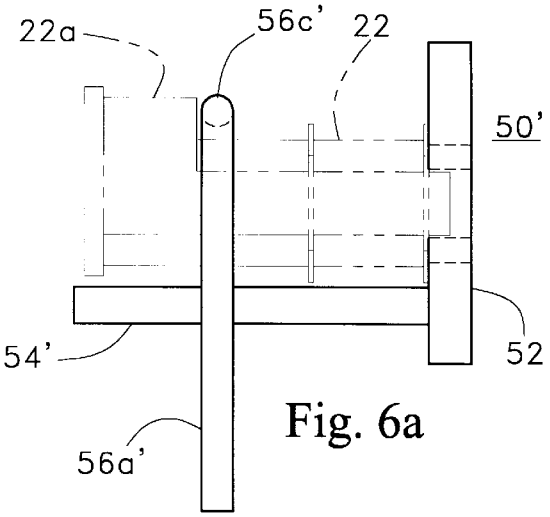
FIGS. 6*a* and 6*b* respectively show side and front views of a modified support assembly of the type shown in FIG. 3*a* and 3*b*.
Figure 6B:
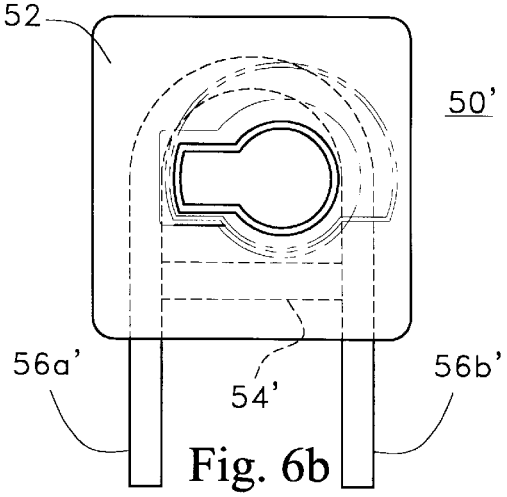

FIGS. 6*a* and 6*b* show an embodiment 50' which is a somewhat modified version of the embodiment 50 shown in FIGS. 3*a* and 3*b,* wherein like elements have been designated by like numerals. For purposes of simplicity, only the modified elements will be described hereinbelow.

Rebar 56' has arms 56*a'* and 56*b'* which are greater in length than arms 56*a* and 56*b* of FIG. 3*a*. Plate 54' is narrower in width than plate 54 of FIG. 3*a*. The openings in plate 54 are omitted and the rebar arms 56*a'* and 56*b'* are welded to opposite vertical sides of plate 54'. Portion 56*c'* of rebar 56 is placed against wall 22*a*-1 in a manner similar to portion 56*c* of rebar 56.

The embodiment shown in FIGS. 6*a* and 6*b* enables the support assembly 50' to be assembled and welded before the insert 22 is placed in position, as shown in FIG. 6*a,* to protect insert 22 from being damaged by the heat of welding.

All of the advantages obtained in the embodiment 50 of FIG. 3*a* are likewise obtained in the embodiment 50' of FIG. 6*a*. In addition, the extended length of arms 56*a'* and 56*b'* and the surface area of plate 54 serve to distribute the forces applied to the cast material over a greater surface area, reducing the potential of fracturing or other like damage to the cast material and counteracting the tendency of the lift pin to pivot during lifting. Increasing the total surface area, by enlarging plate 54 increases the ability of plate 54 to counteract pivoting of the lift pin.

Figure 7A:
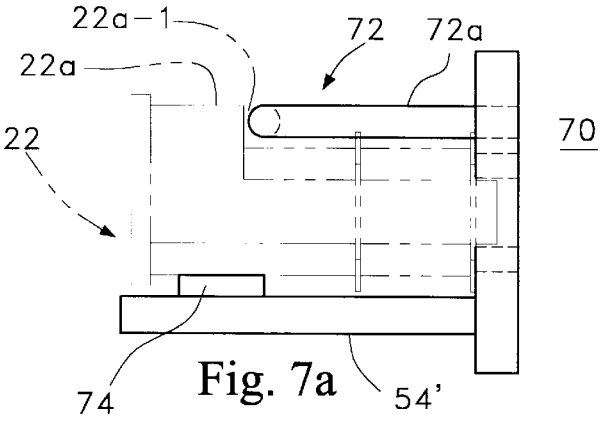
FIGS. 7*a* and 7*b* respectively show side and end views of another embodiment of the present invention.
Figure 7B:
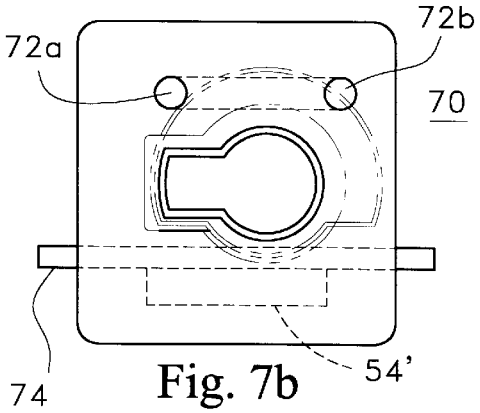

FIGS. 7*a* and 7*b* show still another embodiment 75 of the present invention comprised of faceplate 52 (similar to faceplate 52 of FIG. 3*a*) for receiving insert 22. A plate 54' (similar to plate 54' of FIG. 6*a*) has its right-hand end welded to the left-hand surface of faceplate 52.

A U-shaped rebar 74 is arranged to lie substantially in a horizontal plane and has the free ends of its arms 74*a* and 74*b* welded to the left-hand surface of faceplate 52. Rebar 74 is bent to form a U-shaped member (similar to rebar 56 in FIG. 3*b*) and has its curved portion 74*c* resting against wall 22*a*-1 of the insert.

An elongated plate 72 is arranged in crosswise fashion upon the upper surface of plate 54' and is welded thereto. Plates 54' and 74 cooperate to support insert 22. The increased surface area provided by plates 54' and 74 distribute the stress forces over a greater surface area of the cast material, the advantages of which were pointed out above in the description of the embodiment 70 of FIGS. 6*a* and 6*b*.

The curved portion 74*c* of the rebar prevents pin 19*e* from crushing concrete in the region above insert portion 22*a,* similar to the embodiments described above. Similar to some of the embodiments described above, note FIG. 6*a,* for example, support assembly 70 may be assembled and welded and the insert 22 thereafter placed in the position shown in FIG. 7*a* to protect the insert from being damaged by the heat of welding.

Figure 4:
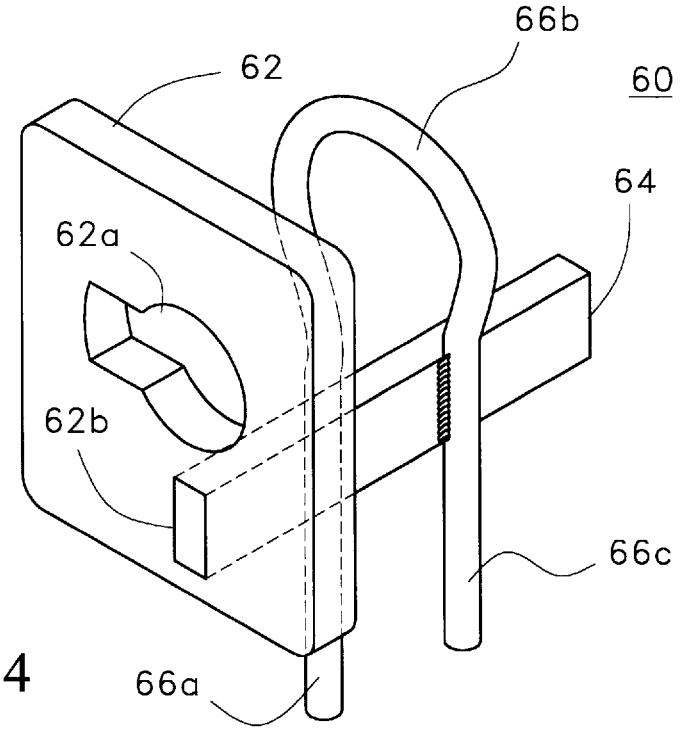
FIG. 4 is a perspective view showing a third preferred embodiment of the insert support assembly of the present invention.

FIG. 4 shows a perspective view of another embodiment 60 of the present invention comprised of faceplate 62, insert support plate 64 and rebar 66, with the insert omitted. Faceplate 62 has a keyhole-shaped opening 62*a* similar to that shown in the faceplates of the embodiments 40 and 50, for receiving the open end of the plastic insert 22. Plate 64, which may be formed of a piece of flat stock, has one end inserted into an opening 62*b* in faceplate 62, and is preferably welded thereto.

Rebar 66 is bent into a substantially U-shaped configuration, having mid portions of the arms 66*a* and 66*b* welded to opposite major faces of the support plate 64, as shown.

The yoke portion 66*b* of rebar 66 has an enlarged diameter and cooperates with plate 64 to substantially encircle an insert 22 placed within the opening formed by members 64 and 66. The faceplate 62, support plate 64 and rebar 66 are initially assembled and welded at the places shown, and the insert 22 is positioned within the assembly after fabrication and cooling thereof to protect the plastic insert from being damaged or distorted due to the heat conducted through the metallic members 62, 64 and 66 during welding thereof. The edge 64*a* of plate 64 lies beneath insert 22.

The embodiment 60 provides all of the advantages of the embodiments 40 and 50 as well as the additional advantages of blocking movement of pin 19*e,* thereby preventing crushing of the concrete adjacent to portion 22*a* of insert 22 when pin 19*e* is moved to the "12 o'clock" position, by positioning the upper curved portion 66*b* of rebar 66 against wall 22*a*-1 (see FIG. 2*a,* for example) as well as providing greater supporting strength for insert 22 due to the vertical orientation of plate 64 as well as providing greater structural strength between the joined members 62 and 64 due to the fact that the plate 64 is able to withstand significantly greater forces exerted in a downward, vertical direction as compared with support plate 54, which is horizontally aligned.

The flow of concrete around the members 22, 54 and 56 in the embodiment 50 of FIGS. 3*a* and 3*b,* as the concrete flows upward during filling of a mold assembly, tends to block the flow causing "slabbing" (i.e. the concrete does not adhere to the metal and "slabs" off). The orientation of the member 64 promotes significantly improved flow of concrete about members 62, 64 and 66, thus preventing "slabbing".

In addition to the above, the vertical orientation of plate 64 assures more even and thorough flow of the cast material between and around the members 22, 62, 64 and 66 during the initial stages of casting to further protect against the formation of air bubbles and/or air pockets.

Figure 8A:
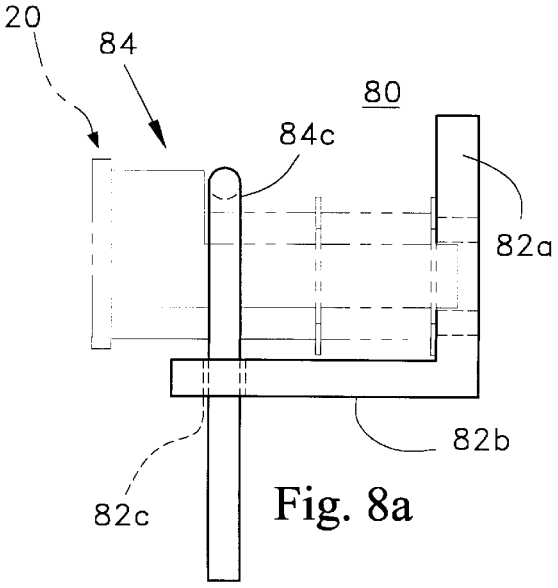
FIGS. 8*a*, 8*b* and 8*c* respectively show side, end and top views of another embodiment of the present invention.
Figure 8B:
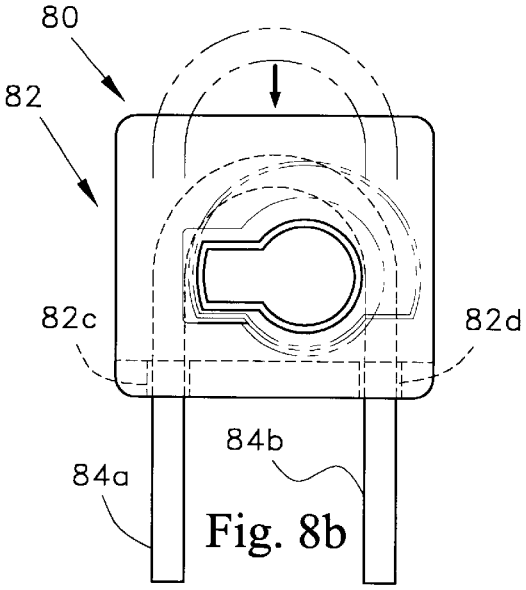
Figure 8C:
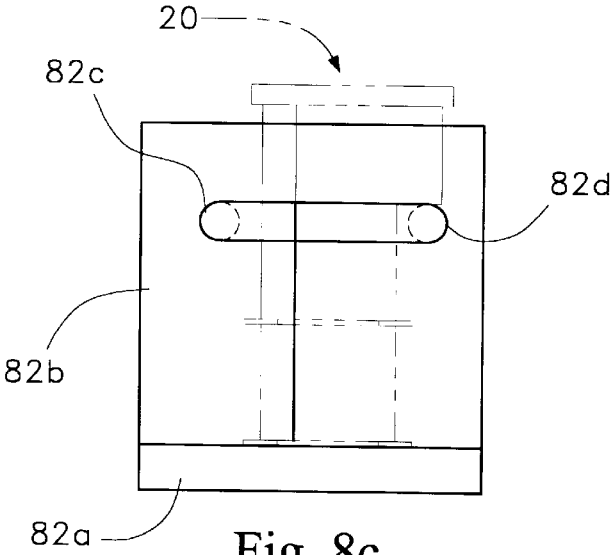
Figure 8D:
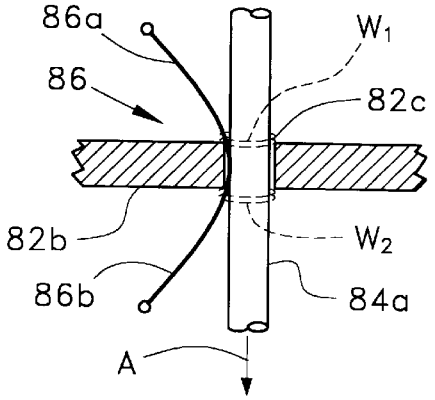
FIG. 8*d* is a sectional view showing a portion of the support assembly useful for explaining securement of a rebar to a mounting plate using a wire tie.

FIGS. 8*a*–8*c* show another embodiment 80 comprising a unitary, one-piece member 82 comprised of a faceplate portion 82*a* and a support plate portion 82*b*. Openings 82*c,* 82*d* are formed in plate portion 82*b* and a U-shaped rebar 84 similar to rebar 56' in FIG. 6*a* is mounted to plate portion 82*b* by inserting arms 84*a* and 84*b* into openings 82*c,* 82*d* respectively. The manner in which each arm of the rebar is secured to support plate 82*b* is through the use of wire ties, as shown, for example, in FIG. 8*d*. Before insertion of each arm into its associated opening, a wire tie 86 is inserted through opening 82*c,* for example, so that substantially equal lengths of the wire tie extend above and below 82*c*. Arm 84*a* is then inserted into opening 82*c* by moving the arm 84*a* downwardly as shown by arrow A. Obviously, both arms 84*a* and 84*b* are inserted simultaneously into their respective openings 82*c,* 82*d* after a wire tie is placed through each opening.

When the U-shaped rebar is in the proper position relative to plate portion 84*b,* each of the ends 86*a* and 86*b* of wire tie 86 are tightly wrapped about arm 84*a* and immediately above and below the respective upper and lower surfaces of support plate 82*b,* the tightly wrapped wire tie portions W1 and W2 being shown in dotted fashion. The wire ties are preferably formed of steel and overlie marginal portions of support plate 82*b* surrounding the opening 82*c,* which secure arm 84*a* to the support plate, preventing relative movement therebetween. The wire tie, being formed of mild steel of a suitable thickness, such as sixteen (16) gauge, remains tightly wound about the rebar.

Insert 20 may be placed in the position shown in FIGS. 8*a*–8*c* either before or after insertion and securement of the rebar 84 to the support plate. The key-shaped opening of insert 22 is fitted into a conforming opening in faceplate portion 82*a,* similar to previous embodiments. The use of wire ties eliminates the need for welding and thus avoids any concern of the plastic insert being damaged due to the heat developed during welding.

The central, curved portion 84*c* of rebar 80 rests against the right-hand wall of the locking pin receiving portion 22*a* of insert 22 to block the locking pin 19*e* (see FIG. 1*d*) from sliding out of the insert when the precast member in which the assembly 80 is mounted is lifted by a lift pin.

Figure 9A:
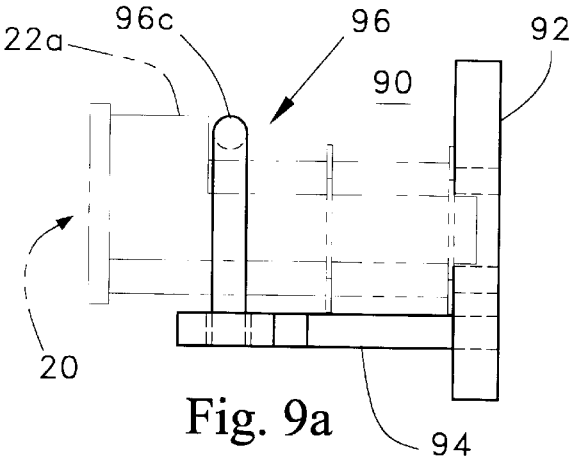
FIGS. 9*a,* 9*b* and 9*c* respectively show side, end and top views of still another embodiment of the present invention.
Figure 9B:
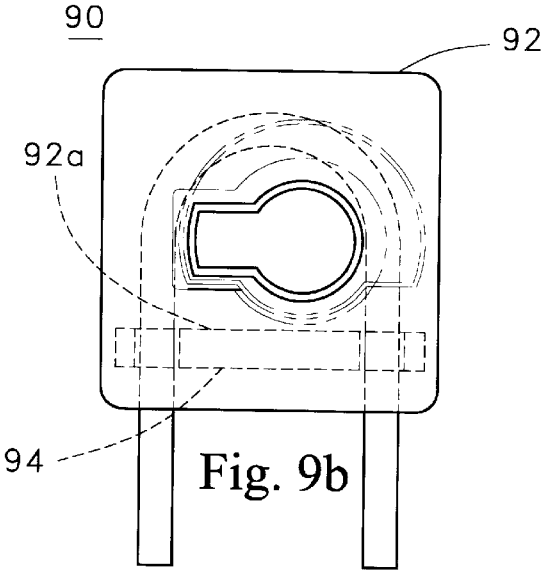
Figure 9C:
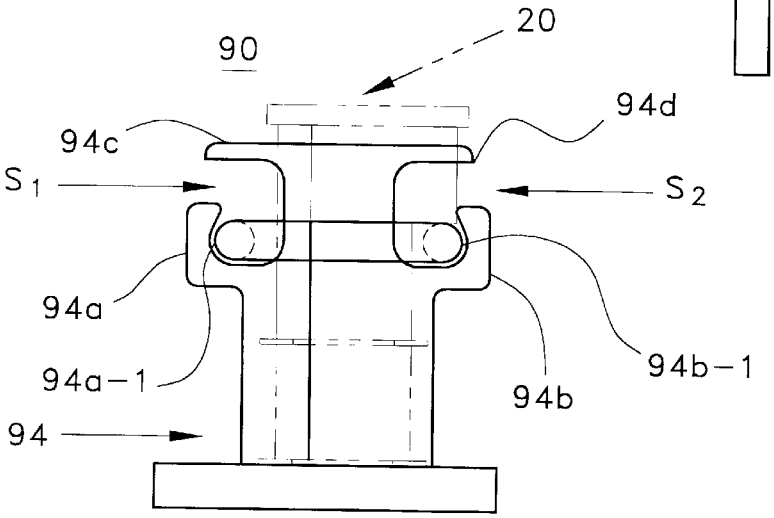

Still another embodiment 90 of the present invention is shown in FIGS. 9*a*–9*c* and is comprised of a faceplate 92 provided with an elongated slot 92*a* for receiving a right-hand end of a support plate 94, which is preferably welded thereto.

Support plate 94 has a pair of integral, hook-shaped projections 94*a*, 94*b* and a pair of substantially linear projections 94*c*, 94*d* which collectively form substantially L-shaped entry slots S1, S2.

A substantially U-shaped rebar 96 is bent so that its arms 96*a*, 96*b* are separated by a distance which is greater than the distance between the arcuate locking surfaces 94*a*-1, 94*b*-1 respectively formed along the interior surfaces of hook-shaped projections 94*a*, 94*b*.

Rebar 96 is mounted to support plate 94 by placing the arms 96*a*, 96*b* into alignment with slots S1 and S2. Arms 96*a* and 96*b* are then urged toward one another in order to force the arms into the region where they are captured by the locking recesses 94*a*-1, 94*b*-1. The arms 96*a*, 96*b* are then released so that they press against the locking recesses. If additional locking strength is required, the arms 96*a*, 96*b* may be secured to support plate 94 through the employment of wire ties, utilizing a technique described hereinabove and shown in FIG. 8*d*.

The key-shaped opening of insert 22 is fitted into a conforming opening in faceplate 92, similar to previous embodiments.

Curved portion 96*c* of the U-shaped rebar is placed against the right-hand wall of the locking pin receiving portion 22*a* of insert 22 to block the locking pin 19*e* from sliding out of the insert when the precast member is lifted by a lift pin. The embodiment 90, in addition to providing all of the structural advantages of previous embodiments, has further advantageous features of simplified assembly and avoiding the need for welding operations to secure members of the support assembly to one another.

Figure 10A:
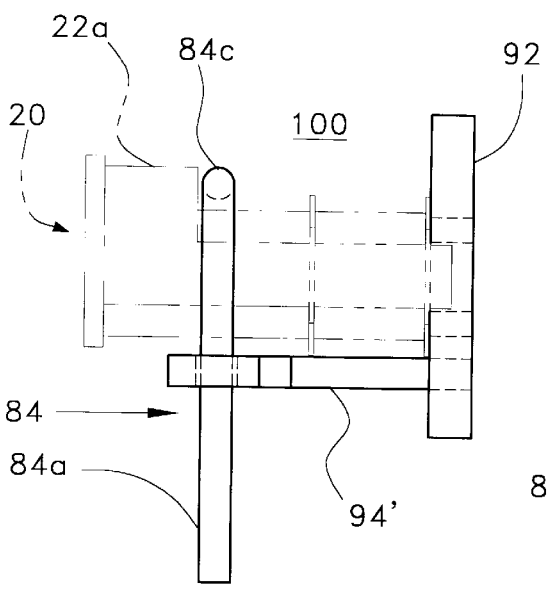
FIGS. 10*a,* 10*b* and 10*c* respectively show side, end and top views of yet another embodiment of the present invention.
Figure 10B:
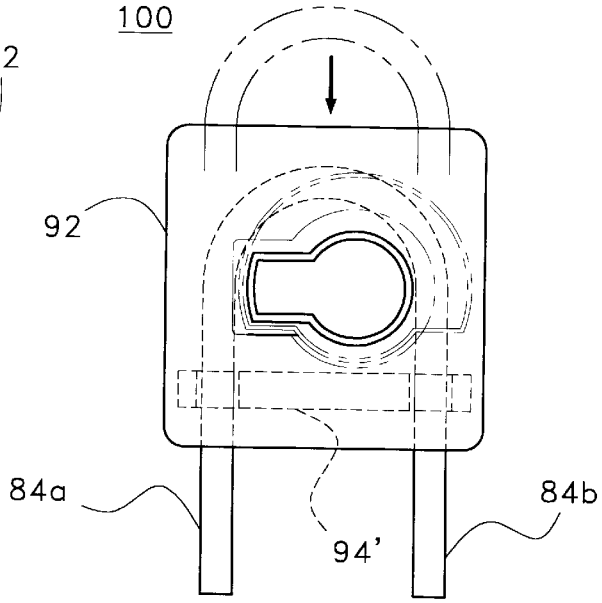
Figure 10C:
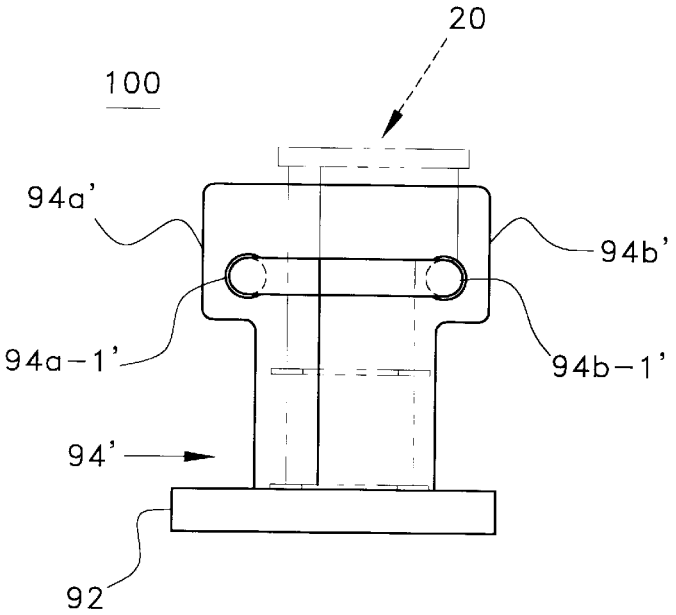

Another embodiment 100, as shown in FIGS. 10*a*–10*c*, is comprised of a faceplate 92 substantially identical to the faceplate 92 of the embodiment shown in FIGS. 9*a*–9*c*. Support plate 94' is somewhat similar to support plate 94 shown in FIGS. 9*a*–9*c* with the modification that the entry slots S1, S2 are replaced by a widened free end portion forming projecting portions 94*a'*, 94*b'*, each of which has an opening 94*a*-1', 94*b*-1' provided therein. U-shaped rebar 84 is substantially identical to U-shaped rebar 84 of FIGS. 8*a*–8*c* and its arms 84*a*, 84*b* are inserted into the respective openings 94*a*-1', 94*b*-1' and, when properly positioned, are secured to support plate 94' using tie wires in a technique similar to that shown in FIG. 8*d*.

Insert 22 may be positioned within the insert support assembly either before or after rebar 84 is secured to support plate 94'. The key-shaped opening of insert 22 is fitted into a conforming opening in faceplate 92, similar to previous embodiments. Curved portion 84*c* of rebar 84 rests against the right-hand surface of locking pin receiving portion 22*a* of insert 22 to block the locking pin 19*e* from sliding out of the insert when the precast member is lifted by lift pins.

Embodiment 100 provides all of the advantages of the previous embodiments in addition to providing simplicity of assembly.

Those embodiments of the present invention employing U-shaped rebars which encircle a portion of the insert, such as the embodiments 40, 50, 50', 80, 90 and 100 have the further advantage of blocking the locking pin 19*e* from sliding out of insert 22 even in the event that the locking pin 19*e* fails to reach the "12 o'clock" position when the precast member is being lifted and moved. This is accomplished by having the U-shaped portion arranged to engage substantially the upper half surface of the locking pin receiving portion of insert 22.

In addition to the above, the insert support assemblies of the present invention are relatively simply to fabricate, and are formed of components which are inexpensive and easy to obtain, thus significantly reducing the cost of such inserts while retaining all of the distinct advantages described hereinabove.

All the embodiments of the present invention described hereinabove share the advantages which have already been set forth, namely the provision of an insert support assembly of significantly increased structural strength as compared with convention insert assemblies enabling to use lifting pins of a smaller size as compared with conventional insert assemblies as well as enabling use of a lift pin of a given size to be utilized over a wider size and weight range of cast members as well as being capable of being simply, and easily fabricated from inexpensive materials.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. Apparatus supporting an insert which receives a lifting member, comprising:

a faceplate having an opening aligned with an opening in said insert;

a member for supporting an intermediate portion of said insert, said supporting member being anchored to said faceplate, whereby loading forces exerted upon the insert are distributed over the engaging surfaces between said supporting member and faceplate, said supporting member comprises an elongated rod and a flat plate joined together to encircle a portion of the insert.

2. The apparatus of claim 1 wherein said flat plate is joined to said faceplate.

3. The apparatus of claim 2 wherein said flat plate and said rod are joined together by welding and said flat plate and said face plate are joined together by welding.

4. The apparatus of claim 1 wherein said flat plate and said faceplate comprise a unitary, one-piece, L-shaped member.

5. The apparatus of claim 2 wherein said flat plate is arranged along an underside of said insert so that said insert lies adjacent to a major face of said flat plate.

6. The apparatus of claim 2 wherein said flat plate is arranged adjacent to an underside of said insert so that said insert lies immediately adjacent an edge of said flat plate.

7. The apparatus of claim 1 wherein said insert has a substantially keyhole-shaped opening, said faceplate having an opening conforming to said substantially key-shaped opening.

8. The apparatus of claim 7 wherein a square-shaped portion of the keyhole-shaped opening in said insert extends into the square-shaped portion of the keyhole-shaped opening in said face plate.

9. The apparatus of claim 1 wherein said insert has a closed end, a hollow locking pin receiving portion adjacent said closed end, and being of an enlarged diameter relative to an intermediate portion of said insert adjacent to said locking pin receiving portion to form an exterior shoulder between said end and intermediate portions;

said member having a portion lying adjacent to said shoulder to prevent the locking pin of a lift pin inserted into said insert from sliding out of the locking pin receiving portion when the cast member is lifted by said lift pin.

10. In combination, a cast member and a lift pin receiving assembly, said cast member being formed of a cementitious material, and having a given thickness;

said lift pin receiving assembly comprising a hollow plastic insert having a closed end and an open end;

the open end of said insert having a keyhole-shaped configuration;

a faceplate having one major surface which is substantially flush with an external surface of said cast member;

said faceplate having an opening conforming in shape to the key-shaped opening of said insert;

means for supporting said insert being joined to said faceplate, whereby a lifting force applied to said cast member by a lifting pin positioned in said insert is distributed over a surface area of said support means and the surface of said faceplate engaging said cementitious material, said supporting means comprising an elongated rod and a flat plate joined together to encircle the insert.

11. The combination of claim 10 wherein said supporting means engages a lift pin locking portion of the insert to block the lift pin from sliding out of the pin locking portion when the cast member is lifted by the lift pin.

12. The combination of claim 10 wherein said supporting means is welded to said faceplate.

13. The combination of claim 10 wherein said supporting means comprises an elongated rod having an intermediate portion encircling said insert.

14. The combination of claim 13 wherein said flat plate is joined to said faceplate.

15. The combination of claim 10 wherein the flat plate and face plate comprise a one-piece, L-shaped member.

16. The combination of claim 14 wherein said flat plate and said rod are joined together by welding and said flat plate and said face plate are joined together by welding.

17. The combination of claim 14 wherein said rod is secured to said flat plate by wire ties wrapped around the rod.

18. The combination of claim 14 wherein said flat plate is arranged along an underside of said insert so that said insert lies adjacent to a major face of said flat plate.

19. The combination of claim 18 wherein a second flat plate is arranged crosswise upon said flat plate and lies between said flat plate and said insert.

20. The combination of claim 19 wherein said second flat plate is welded to said flat plate.

21. The combination of claim 14 wherein said flat plate is arranged adjacent to an underside of said insert so that said insert lies immediately adjacent an edge of said flat plate.

22. The combination of claim 10 wherein said insert has a closed end, a hollow locking pin receiving portion adjacent said closed end, and being of an enlarged diameter relative to an intermediate portion of said insert adjacent to lock pin receiving portion to form an exterior shoulder between said end and intermediate portions;

said rod having a portion lying adjacent to said shoulder.

23. The apparatus of claim 10 wherein said rod is U-shaped and said flat plate is provided with openings, each receiving an arm of said U-shaped rod; and wire ties being wrapped about two spaced portions of each arm and adjacent to opposite surfaces of said flat plate to secure said arms to said flat plate.

24. The apparatus of claim 10 wherein said flat plate has substantially L-shaped entry slots along opposite sides of said flat plate, said rod being U-shaped, each arm of said U-shaped rod being pressed against curved holding recesses in said entry slots for snap-fittingly receiving said arms.

25. A method for producing an insert assembly for embedment in cast members said insert assembly including a hollow insert member having a keyhole-shaped open end and a portion adjacent a closed end thereof for receiving a projection provided on an insert pin insertable into said insert, said method comprising the steps of:

(a) providing a flat, rigid faceplate;

(b) forming a keyhole-shaped opening in said faceplate conforming to the keyhole-shaped opening in said insert;

(c) providing an elongated rebar;

(d) bending said rebar into a U-shaped form having a curved intermediate portion and a pair of arms;

(e) arranging the U-shaped rebar so that the curved portion is positioned to engage a locking pin receiving portion of the insert;

(f) securing the free arms of said rebar to a joining member of said faceplate.

26. The method of claim 25 wherein step (f) comprises welding the rebar to the faceplate.

27. The method of claim 25 wherein step (f) comprises wrapping wire ties about the rebar to secure the rebar to the faceplate.

28. The method of claim 25 further comprising:

(g) providing a second elongated rebar;

(h) bending said second rebar into an L-shaped form;

(i) moving the square-shaped portion of the keyhole-shaped opening in said insert into a square-shaped portion of the keyhole-shaped opening in said faceplate; and (j) securing a free end of one of the arms of said L-shaped rebar to said faceplate whereby the remaining arm of said L-shaped rebar is positioned adjacent to the closed end of said insert.

29. The method of claim 25 wherein said joining member is a flat plate, further comprising:

(g) arranging the flat plate adjacent the insert; and (h) securing one end of the flat plate to the faceplate.

30. The method of claim 25 wherein step (f) comprises securing the arms of the U-shaped rebar to the flat plate with wire ties.

31. The method of claim 30 wherein the wire ties are wrapped around each arm at two places arranged on and engaging opposite sides of the flat plate.

32. The method of claim 30 wherein the arms of the U-shaped member are inserted into openings in said flat plate before being wrapped with the wire ties.

33. The method of claim 30 wherein the arms of the U-shaped member are inserted into openings provided by hook-shaped projections in said flat plate before being wrapped with the wire ties.

34. The method of claim 33 wherein the arms of the U-shaped rebar are pressed towards one another to slide the arms relative to the flat plate and are released when in the desired position whereupon the arms are snap-fitted into engagement with holding recesses provided along inner surfaces of the hook-shaped projections to retain the U-shaped rebar in position.

35. The method of claim 25 wherein step (f) comprises inserting a wire tie into each opening provided in said flat plate for respectively receiving each arm of the U-shaped rebar;

positioning the wire tie so that an intermediate portion is aligned with its associated opening;

inserting each arm into an associated opening; and wrapping each free end of each wire tie about its associated arm so that at least a portion of the wrapped wire overlies a surface of the flat plate to secure the U-shaped rebar to the flat plate.

36. The method claim 29 further comprising:

(i) placing a second flat plate crosswise upon said flat plate and between said flat plate and said insert; and (j) securing the second flat plate to said flat plate.

37. The method of claim 36 wherein step (d) further includes the step of orienting the flat support plate so that an edge thereof adjacent to the edge joined to said faceplate is positioned adjacent to an underside of said insert when said insert is properly positioned with the square-shaped portion of its keyhole-shaped opening inserted into the square-shaped portion of the keyhole-shaped opening in said faceplate.

38. The method of claim 36 wherein said flat plate and rebar are welded in place before said insert is placed between the rebar and the flat plate to prevent the insert for being damaged by the heat of welding.

39. A method for producing an insert assembly for embedment in cast members, said insert assembly including a hollow insert member having a key-shaped open end and a portion adjacent a closed end thereof for receiving a locking projection provided on an insert pin insertable into said insert, said method comprising the steps of:

(a) providing a flat, rigid faceplate;

(b) forming a keyhole-shaped opening in said faceplate conforming to the keyhole-shaped opening in said insert;

(c) providing a flat, rigid support plate;

(d) welding one end of said flat support plate to one major surface of said faceplate;

(e) providing an elongated rebar;

(f) bending said elongated rebar into a substantially U-shaped configuration;

(g) securing free ends of said U-shaped rebar to said flat support plate and said face plate; and (h) placing said insert between said rebar and said flat plate so that said square-shaped portion of said insert is inserted into the square-shaped portion of the keyhole-shaped opening in said faceplate.

40. The method of claim 39 wherein step (d) further includes the step of orienting the flat support plate so that a major face thereof is positioned adjacent an undersurface of said insert when said insert is properly oriented with its square-shaped portion inserted in the square-shaped portion of the keyhole-shaped opening in said faceplate.

* * * * *